US007409068B2

(12) United States Patent
Ryan et al.

(10) Patent No.: US 7,409,068 B2
(45) Date of Patent: Aug. 5, 2008

(54) LOW-NOISE DIRECTIONAL MICROPHONE SYSTEM

(75) Inventors: Jim G. Ryan, Ottawa (CA); Brian D. Csermak, Dundas (CA)

(73) Assignee: Sound Design Technologies, Ltd., Burlington, Ontario (CA)

( * ) Notice: Subject to any disclaimer, the term of this patent is extended or adjusted under 35 U.S.C. 154(b) by 733 days.

(21) Appl. No.: 10/383,141

(22) Filed: Mar. 6, 2003

(65) Prior Publication Data

US 2003/0169891 A1 Sep. 11, 2003

Related U.S. Application Data

(60) Provisional application No. 60/362,677, filed on Mar. 8, 2002.

(51) Int. Cl.
*H04R 25/00* (2006.01)

(52) U.S. Cl. ..... 381/313; 381/92; 381/97

(58) Field of Classification Search ..... 381/92, 381/317, 313, 97, 356, 111–115, 320
See application file for complete search history.

(56) References Cited

U.S. PATENT DOCUMENTS

| | | | | |
|---|---|---|---|---|
| 4,399,327 | A | 8/1983 | Yamamoto et al. | |
| 4,527,282 | A | 7/1985 | Chaplin et al. | |
| 4,536,887 | A | 8/1985 | Kaneda et al. | |
| 4,653,102 | A | 3/1987 | Hansen | |
| 4,703,506 | A | 10/1987 | Sakamoto et al. | |
| 4,731,850 | A | 3/1988 | Levitt et al. | |
| 4,879,749 | A | 11/1989 | Levitt et al. | |
| 5,058,170 | A | 10/1991 | Kanamori et al. | |
| 5,137,110 | A | 8/1992 | Bedard, Jr. et al. | |
| 5,226,076 | A | 7/1993 | Baumhauer, Jr. et al. | |
| 5,226,087 | A * | 7/1993 | Ono et al. | 381/92 |
| 5,289,544 | A | 2/1994 | Franklin | |
| 5,400,409 | A * | 3/1995 | Linhard | 381/92 |
| 5,473,701 | A | 12/1995 | Cezanne et al. | |

(Continued)

FOREIGN PATENT DOCUMENTS

| | | |
|---|---|---|
| EP | 0802699 | 10/1997 |

(Continued)

OTHER PUBLICATIONS

Frost, Otis Lamont, "An Algorithm for Linearly Constrained Adaptive Array Processing" Proceedings of the IEEE, vol. 60, No. 8, pp. 926-935.*

(Continued)

*Primary Examiner*—Vivian Chin
*Assistant Examiner*—Jason R Kurr
(74) *Attorney, Agent, or Firm*—Van Dyke, Gardner, Linn & Burkhart, LLP

(57) ABSTRACT

A low-noise directional microphone system includes a front microphone, a rear microphone, a low-noise phase-shifting circuit and a summation circuit. The front microphone generates a front microphone signal, and the rear microphone generates a rear microphone signal. The low-noise phase-shifting circuit implements a frequency-dependent phase difference between the front microphone signal and the rear microphone signal to create a controlled loss in directional gain and to maintain a maximum level of noise amplification over a pre-determined frequency band. The summation circuit combines the front and rear microphone signals to generate a directional microphone signal.

3 Claims, 10 Drawing Sheets

U.S. PATENT DOCUMENTS

| | | | | |
|---|---|---|---|---|
| 5,483,599 | A | 1/1996 | Zagorski | |
| 5,524,056 | A | 6/1996 | Killion et al. | |
| 5,581,620 | A | 12/1996 | Brandstein et al. | |
| 5,732,143 | A | 3/1998 | Andrea et al. | |
| 5,737,430 | A | 4/1998 | Widrow | |
| 5,757,933 | A | 5/1998 | Preves et al. | |
| 5,764,778 | A | 6/1998 | Zurek | |
| 5,785,661 | A | 7/1998 | Shennib | |
| 5,793,875 | A | 8/1998 | Lehr et al. | |
| 5,825,897 | A | 10/1998 | Andrea et al. | |
| 5,862,240 | A | 1/1999 | Ohkubo et al. | |
| 6,002,776 | A | 12/1999 | Bhadkamkar et al. | |
| 6,061,456 | A | 5/2000 | Andrea et al. | |
| 6,069,961 | A | 5/2000 | Nakazawa | |
| 6,084,973 | A | 7/2000 | Green et al. | |
| 6,101,258 | A | 8/2000 | Killion et al. | |
| 6,122,389 | A | 9/2000 | Grosz | |
| 6,154,552 | A | 11/2000 | Koroljow et al. | |
| 6,192,134 | B1 | 2/2001 | White et al. | |
| 6,222,927 | B1 | 4/2001 | Feng et al. | |
| 6,327,370 | B1 | 12/2001 | Killion et al. | |
| 6,473,514 | B1 | 10/2002 | Bodley et al. | |
| 6,654,468 | B1 * | 11/2003 | Thompson | 381/92 |
| 6,751,325 | B1 * | 6/2004 | Fischer | 381/313 |
| 6,766,029 | B1 * | 7/2004 | Maisano | 381/313 |
| 6,954,535 | B1 | 10/2005 | Arndt et al. | |
| 2003/0147538 | A1 * | 8/2003 | Elko | 381/92 |

FOREIGN PATENT DOCUMENTS

| | | | |
|---|---|---|---|
| EP | WO 99/04598 | * | 1/1999 |
| EP | 1351544 | | 8/2003 |

OTHER PUBLICATIONS

The European Search Report for EP application 03005062.9 (corresponding to EP publication 1 351 544) which is the European counterpart to the present application.

* cited by examiner

LOW-NOISE DIRECTIONAL MICROPHONE SYSTEM

CROSS-REFERENCE TO RELATED APPLICATION

This application claims priority from and is related to the following prior application: "Low-Noise, First Order Differential Microphone Array," U.S. Provisional Application No. 60/362,677, filed Mar. 8, 2002. This prior application, including the entire written description and drawing figures, is hereby incorporated into the present application by reference.

FIELD

The technology described in this patent application relates generally to directional microphone systems. More specifically, the patent application describes a low-noise directional microphone system that is particularly well suited for use in a digital hearing instrument.

BACKGROUND

Directional microphone systems are known. FIG. 1 is a block diagram illustrating a known method for implementing a directional microphone system 1. The system 1 includes a front microphone 2, a rear microphone 3, a delay 4, an adder 5, and an equalizer 6. The microphones 1, 2 are typically omnidirectional pressure microphones, but matched, directional microphones are also used. The system 1 forms a directional response pattern, with a beam pointing toward the front microphone 2, by subtracting a delayed rear microphone signal from a front microphone signal. The equalizer 6 then equalizes the directional response pattern to that of a single, omnidirectional microphone. In this manner, a variety of directional patterns can be implemented by varying the amount of delay.

Typical directional hearing instruments include a directional microphone system 1, such as the one illustrated in FIG. 1, having a two microphone first order differential beamformer in which a 6 dB per octave roll off in the low end of the frequency response is realized. As a result of this decreased signal strength at lower frequencies, typical directional hearing instruments have a reduced signal to noise ratio (SNR). Thus, the frequency response is typically equalized, as shown in FIG. 1, by applying gain at lower frequencies. Internally generated microphone noise, however, is typically amplified along with the signal, minimizing the improvement to the SNR of the microphone system 1. Similarly, wind noise is typically higher in directional hearing instruments due to the additional gain required to equalize the frequency response.

FIG. 2 is a graph 7 illustrating noise amplification (in dB) 8 in a typical directional microphone system 1, plotted as a function of frequency. The noise amplification 8 plotted in FIG. 2 is typical for a conventional, two microphone system, as shown in FIG. 1, with a port spacing of 10.7 mm and a hyper-cardioid beam pattern. As illustrated, the amount of noise amplification, i.e., the microphone self-noise, in a typical microphone system 1 increases at low frequencies and, at 100 Hz, the microphone self-noise may be amplified by 35 dB.

SUMMARY

A low-noise directional microphone system includes a front microphone, a rear microphone, a low-noise phase-shifting circuit and a summation circuit. The front microphone generates a front microphone signal, and the rear microphone generates a rear microphone signal. The low-noise phase-shifting circuit implements a frequency-dependent phase difference between the front microphone signal and the rear microphone signal to create a controlled loss in directional gain and to maintain a maximum level of noise amplification over a pre-determined frequency band. The summation circuit combines the front and rear microphone signals to generate a directional microphone signal.

DETAILED DESCRIPTION

Figure 3A:
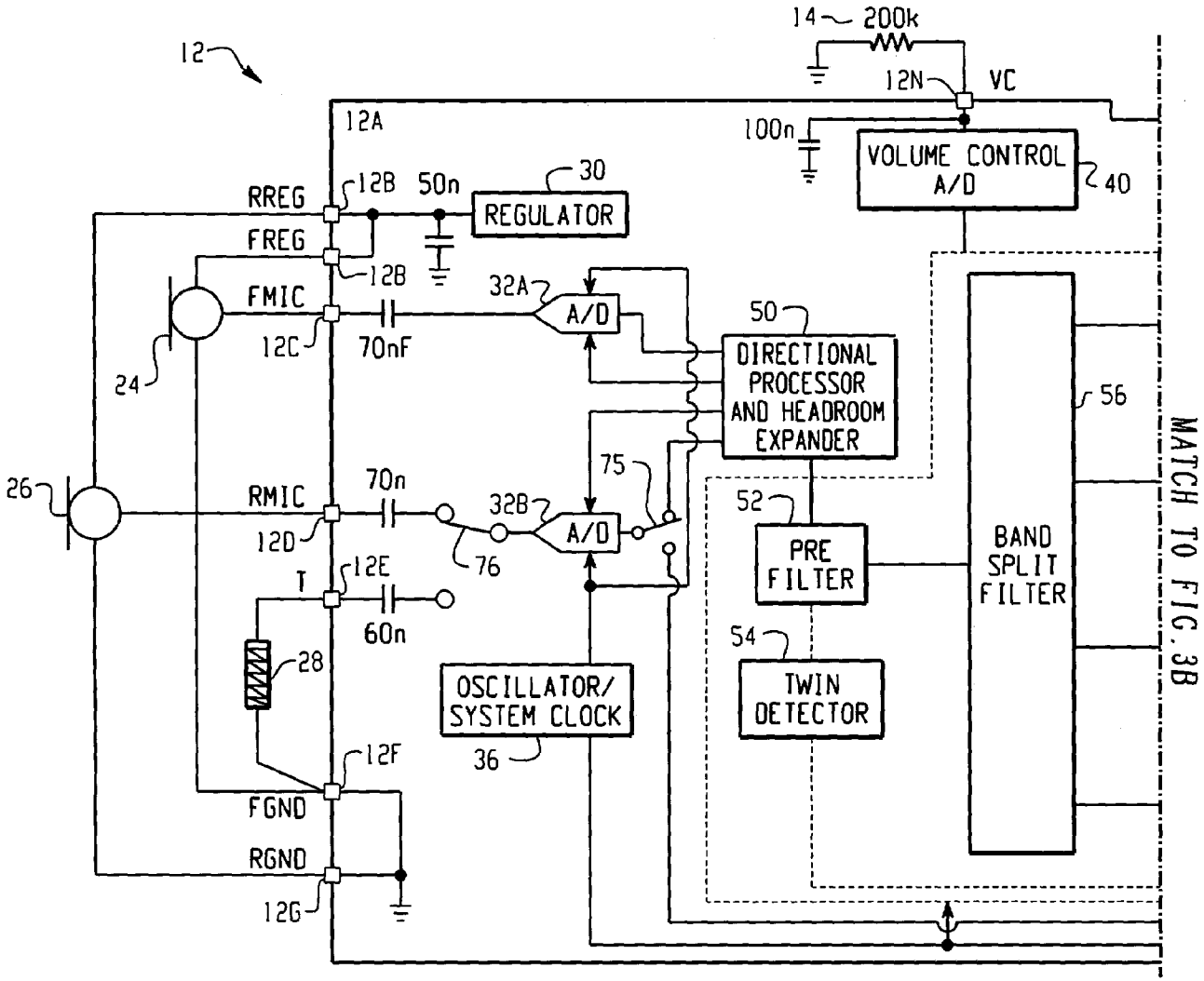
FIGS. 3A and 3B show a block diagram of an exemplary digital hearing aid system 12 in which a low-noise directional microphone system may be utilized.
Figure 3B:
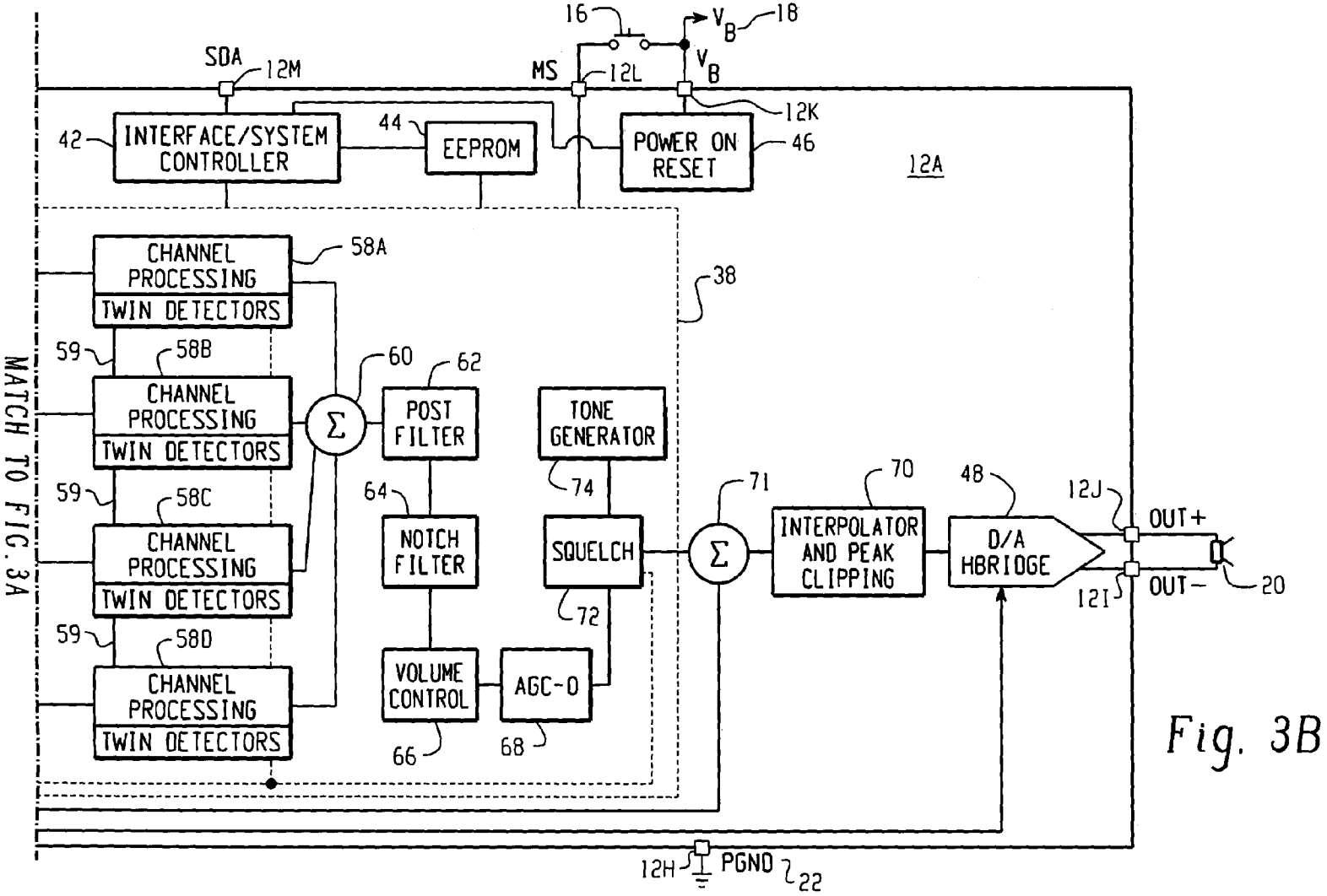

Referring now to the remaining drawing figures, FIG. 3 is a block diagram of an exemplary digital hearing aid system 12 in which a low-noise directional microphone system, as described herein, may be utilized. The digital hearing aid system 12 includes several external components 14, 16, 18, 20, 22, 24, 26, 28, and, preferably, a single integrated circuit (IC) 12A. The external components include a pair of microphones 24, 26, a tele-coil 28, a volume control potentiometer 24, a memory-select toggle switch 16, battery terminals 18, 22, and a speaker 20.

Sound is received by the pair of microphones 24, 26, and converted into electrical signals that are coupled to the FMIC 12C and RMIC 12D inputs to the IC 12A. FMIC refers to "front microphone," and RMIC refers to "rear microphone." The microphones 24, 26 are biased between a regulated voltage output from the RREG and FREG pins 12B, and the ground nodes FGND 12F, RGND 12G. The regulated voltage output on FREG and RREG is generated internally to the IC 12A by regulator 30.

The tele-coil 28 is a device used in a hearing aid that magnetically couples to a telephone handset and produces an input current that is proportional to the telephone signal. This input current from the tele-coil 28 is coupled into the rear microphone A/D converter 32B on the IC 12A when the switch 76 is connected to the "T" input pin 12E, indicating that the user of the hearing aid is talking on a telephone. The tele-coil 28 is used to prevent acoustic feedback into the system when talking on the telephone.

The volume control potentiometer 14 is coupled to the volume control input 12N of the IC. This variable resistor is used to set the volume sensitivity of the digital hearing aid.

The memory-select toggle switch 16 is coupled between the positive voltage supply VB 18 to the IC 12A and the memory-select input pin 12L. This switch 16 is used to toggle the digital hearing aid system 12 between a series of setup configurations. For example, the device may have been previously programmed for a variety of environmental settings, such as quiet listening, listening to music, a noisy setting, etc. For each of these settings, the system parameters of the IC 12A may have been optimally configured for the particular user. By repeatedly pressing the toggle switch 16, the user may then toggle through the various configurations stored in the read-only memory 44 of the IC 12A.

The battery terminals 12K, 12H of the IC 12A are preferably coupled to a single 1.3 volt zinc-air battery. This battery provides the primary power source for the digital hearing aid system.

The last external component is the speaker 20. This element is coupled to the differential outputs at pins 12J, 12I of the IC 12A, and converts the processed digital input signals from the two microphones 24, 26 into an audible signal for the user of the digital hearing aid system 12.

There are many circuit blocks within the IC 12A. Primary sound processing within the system is carried out by the sound processor 38. A pair of A/D converters 32A, 32B are coupled between the front and rear microphones 24, 26, and the sound processor 38, and convert the analog input signals into the digital domain for digital processing by the sound processor 38. A single D/A converter 48 converts the processed digital signals back into the analog domain for output by the speaker 20. Other system elements include a regulator 30, a volume control A/D 40, an interface/system controller 42, an EEPROM memory 44, a power-on reset circuit 46, and an oscillator/system clock 36.

The sound processor 38 preferably includes a directional processor 50, a pre-filter 52, a wide-band twin detector 54, a band-split filter 56, a plurality of narrow-band channel processing and twin detectors 58A- 58D, a summer 60, a post filter 62, a notch filter 64, a volume control circuit 66, an automatic gain control output circuit 68, a peak clipping circuit 70, a squelch circuit 72, and a tone generator 74.

Operationally, the sound processor 38 processes digital sound as follows. Sound signals input to the front and rear microphones 24, 26 are coupled to the front and rear A/D converters 32A, 32B, which are preferably Sigma-Delta modulators followed by decimation filters that convert the analog sound inputs from the two microphones into a digital equivalent. Note that when a user of the digital hearing aid system is talking on the telephone, the rear A/D converter 32B is coupled to the tele-coil input "T" 12E via switch 76. Both of the front and rear A/D converters 32A, 32B are clocked with the output clock signal from the oscillator/system clock 36 (discussed in more detail below). This same output clock signal is also coupled to the sound processor 38 and the D/A converter 48.

The front and rear digital sound signals from the two A/D converters 32A, 32B are coupled to the directional processor and headroom expander 50 of the sound processor 38. The rear A/D converter 32B is coupled to the processor 50 through switch 75. In a first position, the switch 75 couples the digital output of the rear A/D converter 32 B to the processor 50, and in a second position, the switch 75 couples the digital output of the rear A/D converter 32B to summation block 71 for the purpose of compensating for occlusion.

Occlusion is the amplification of the users own voice within the ear canal. The rear microphone can be moved inside the ear canal to receive this unwanted signal created by the occlusion effect. The occlusion effect is usually reduced in these types of systems by putting a mechanical vent in the hearing aid. This vent, however, can cause an oscillation problem as the speaker signal feeds back to the microphone(s) through the vent aperture. The system shown in FIG. 3 solves this problem by canceling the unwanted signal received by the rear microphone 26 by feeding forward the rear signal from the A/D converter 32B to summation circuit 71. The summation circuit 71 then subtracts the unwanted signal from the processed composite signal to thereby compensate for the occlusion effect.

The directional processor and headroom expander 50 includes a combination of filtering and delay elements that, when applied to the two digital input signals, forms a single, directionally-sensitive response. This directionally-sensitive response is generated such that the gain of the directional processor 50 will be a maximum value for sounds coming from the front of the hearing instrument and will be a minimum value for sounds coming from the rear.

The headroom expander portion of the processor 50 significantly extends the dynamic range of the A/D conversion. It does this by dynamically adjusting the A/D converters 32A/32B operating points. The headroom expander 50 adjusts the gain before and after the A/D conversion so that the total gain remains unchanged, but the intrinsic dynamic range of the A/D converter block 32A/32B is optimized to the level of the signal being processed.

The output from the directional processor and headroom expander 50 is coupled to a pre-filter 52, which is a general-purpose filter for pre-conditioning the sound signal prior to any further signal processing steps. This "pre-conditioning" can take many forms, and, in combination with corresponding "post-conditioning" in the post filter 62, can be used to generate special effects that may be suited to only a particular class of users. For example, the pre-filter 52 could be configured to mimic the transfer function of the user's middle ear, effectively putting the sound signal into the "cochlear domain." Signal processing algorithms to correct a hearing impairment based on, for example, inner hair cell loss and outer hair cell loss, could be applied by the sound processor 38. Subsequently, the post-filter 62 could be configured with the inverse response of the pre-filter 52 in order to convert the sound signal back into the "acoustic domain" from the "cochlear domain." Of course, other pre-conditioning/post-conditioning configurations and corresponding signal processing algorithms could be utilized.

The pre-conditioned digital sound signal is then coupled to the band-split filter 56, which preferably includes a bank of filters with variable corner frequencies and pass-band gains. These filters are used to split the single input signal into four distinct frequency bands. The four output signals from the band-split filter 56 are preferably in-phase so that when they are summed together in block 60, after channel processing, nulls or peaks in the composite signal (from the summer) are minimized.

Channel processing of the four distinct frequency bands from the band-split filter 56 is accomplished by a plurality of channel processing/twin detector blocks 58A-58D. Although four blocks are shown in FIG. 3, it should be clear that more than four (or less than four) frequency bands could be generated in the band-split filter 56, and thus more or less than four channel processing/twin detector blocks 58 may be utilized with the system.

Each of the channel processing/twin detectors 58A-58D provide an automatic gain control ("AGC") function that provides compression and gain on the particular frequency band (channel) being processed. Compression of the channel signals permits quieter sounds to be amplified at a higher gain than louder sounds, for which the gain is compressed. In this manner, the user of the system can hear the full range of sounds since the circuits 58A-58D compress the full range of normal hearing into the reduced dynamic range of the individual user as a function of the individual user's hearing loss within the particular frequency band of the channel.

The channel processing blocks 58A-58D can be configured to employ a twin detector average detection scheme while compressing the input signals. This twin detection scheme includes both slow and fast attack/release tracking modules that allow for fast response to transients (in the fast tracking module), while preventing annoying pumping of the input signal (in the slow tracking module) that only a fast time constant would produce. The outputs of the fast and slow tracking modules are compared, and the compression slope is then adjusted accordingly. The compression ratio, channel gain, lower and upper thresholds (return to linear point), and the fast and slow time constants (of the fast and slow tracking modules) can be independently programmed and saved in memory 44 for each of the plurality of channel processing blocks 58A-58D.

FIG. 3 also shows a communication bus 59, which may include one or more connections, for coupling the plurality of channel processing blocks 58A-58D. This inter-channel communication bus 59 can be used to communicate information between the plurality of channel processing blocks 58A-58D such that each channel (frequency band) can take into account the energy level (or some other measure) from the other channel processing blocks. Preferably, each channel processing block 58A-58D would take into account the energy level from the higher frequency channels. In addition, the energy level from the wide-band detector 54 may be used by each of the relatively narrow-band channel processing blocks 58A-58D when processing their individual input signals.

After channel processing is complete, the four channel signals are summed by summer 60 to form a composite signal. This composite signal is then coupled to the post-filter 62, which may apply a post-processing filter function as discussed above. Following post-processing, the composite signal is then applied to a notch-filter 64, that attenuates a narrow band of frequencies that is adjustable in the frequency range where hearing aids tend to oscillate. This notch filter 64 is used to reduce feedback and prevent unwanted "whistling" of the device. Preferably, the notch filter 64 may include a dynamic transfer function that changes the depth of the notch based upon the magnitude of the input signal.

Following the notch filter 64, the composite signal is then coupled to a volume control circuit 66. The volume control circuit 66 receives a digital value from the volume control A/D 40, which indicates the desired volume level set by the user via potentiometer 14, and uses this stored digital value to set the gain of an included amplifier circuit.

From the volume control circuit, the composite signal is then coupled to the AGC-output block 68. The AGC-output circuit 68 is a high compression ratio, low distortion limiter that is used to prevent pathological signals from causing large scale distorted output signals from the speaker 20 that could be painful and annoying to the user of the device. The composite signal is coupled from the AGC-output circuit 68 to a squelch circuit 72, that performs an expansion on low-level signals below an adjustable threshold. The squelch circuit 72 uses an output signal from the wide-band detector 54 for this purpose. The expansion of the low-level signals attenuates noise from the microphones and other circuits when the input S/N ratio is small, thus producing a lower noise signal during quiet situations. Also shown coupled to the squelch circuit 72 is a tone generator block 74, which is included for calibration and testing of the system.

The output of the squelch circuit 72 is coupled to one input of summer 71. The other input to the summer 71 is from the output of the rear A/D converter 32B, when the switch 75 is in the second position. These two signals are summed in summer 71, and passed along to the interpolator and peak clipping circuit 70. This circuit 70 also operates on pathological signals, but it operates almost instantaneously to large peak signals and is high distortion limiting. The interpolator shifts the signal up in frequency as part of the D/A process and then the signal is clipped so that the distortion products do not alias back into the baseband frequency range.

The output of the interpolator and peak clipping circuit 70 is coupled from the sound processor 38 to the D/A H-Bridge 48. This circuit 48 converts the digital representation of the input sound signals to a pulse density modulated representation with complimentary outputs. These outputs are coupled off-chip through outputs 12J, 12I to the speaker 20, which low-pass filters the outputs and produces an acoustic analog of the output signals. The D/A H-Bridge 48 includes an interpolator, a digital Delta-Sigma modulator, and an H-Bridge output stage. The D/A H-Bridge 48 is also coupled to and receives the clock signal from the oscillator/system clock 36 (described below).

The interface/system controller 42 is coupled between a serial data interface pin 12M on the IC 12, and the sound processor 38. This interface is used to communicate with an external controller for the purpose of setting the parameters of the system. These parameters can be stored on-chip in the EEPROM 44. If a "black-out" or "brown-out" condition occurs, then the power-on reset circuit 46 can be used to signal the interface/system controller 42 to configure the system into a known state. Such a condition can occur, for example, if the battery fails.

Figure 4:
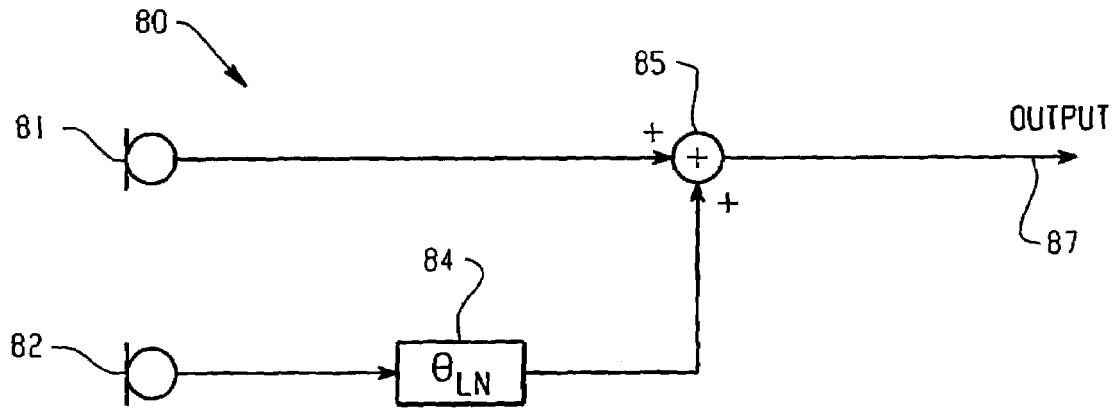
FIG. 4 is a block diagram of an exemplary low-noise directional microphone system.

FIG. 4 is a block diagram of an exemplary low-noise directional microphone system 80. The microphone system 80 includes a front microphone 81, a rear microphone 82, a low-noise phase-shifting circuit 84, and a summation circuit 85. In operation, the microphone system 80 applies a frequency-specific phase shift, $\theta_{LN}$, to the rear microphone signal, and combines the resultant signal with the front microphone signal to create a controlled loss in directional gain over a frequency band of interest. The frequency-specific phase shift, $\theta_{LN}$, is calculated, as described below, such that the amount of audible low-frequency noise may be reduced while maintaining directionality and a targeted amount of low-frequency sensitivity or signal-to-noise ratio (SNR).

The front and rear microphones 81, 82 are preferably omnidirectional microphones that receive an acoustical waveform and generate a front and rear microphone signal, respectively.

The front microphone signal is coupled to the summation circuit 85, and the rear microphone signal is coupled to the low-noise phase-shifting circuit 84. The low-noise phase-shifting circuit 84 implements a frequency-dependent phase shift, $\theta_{LN}$, that maintains a maximum desired noise amplification level ($G_N$) in the resultant directional microphone signal. Exemplary maximum noise amplification levels ($G_N$) are described below with reference to FIG. 7. The output from the low-noise phase-shifting circuit 84 is then added to the front microphone signal by the summation circuit 85 to generate the directional microphone signal 87.

The phase shift implemented by the low-noise phase-shifting circuit 84 may be calculated from array processing theory. This theory states that the directional gain (D) of an arbitrary array at a frequency f can be expressed in matrix notation as:

$$D(f) = \frac{w^H(f)R_S(f)w(f)}{w^H(f)R_N(f)w(f)}$$

In this expression, $R_S(f)$ and $R_N(f)$ are matrices describing the signal and noise correlation properties, respectively. The term w(f) is the sensor-weight vector, and the superscript "H" denotes the conjugate transpose of a matrix. The sensor-weight vector, w(f), is a mathematical description of the actual signal modifications that result from the application of the low-noise phase-shifting circuit 84.

Expressions for the matrix quantities, $R_S(f)$ and $R_N(f)$, can be obtained by assuming a specific array geometry. For the purposes of directional microphone processing, the signal wavefront is assumed to arrive from a single, fixed direction (usually to the front of a hearing instrument user). Thus, the signal correlation matrix, $R_S(f)$, can be expressed as:

$$R_S(f)=s(f)s(f)^H$$

s(f) in the above equation is the signal propagation vector:

$$s(f) = \begin{bmatrix} 1 \\ e^{-jkd} \end{bmatrix},$$

where k is the wavenumber and d is the distance between the front and rear microphones 81, 82.

Assuming a spherically isotropic (or diffuse) noise field, the noise correlation matrix, $R_N(f)$, can be expressed as:

$$R_N(f) = \begin{bmatrix} 1 & \frac{\sin(kd)}{kd} \\ \frac{\sin(kd)}{kd} & 1 \end{bmatrix}$$

The sensor-weight vector, w(f), may be expressed in terms of the front and rear microphone filter responses, as follows:

$$w(f) = \begin{bmatrix} H_f(f) \\ H_r(f) \end{bmatrix},$$

where $H_f(f)$ is a complex frequency response associated with the front microphone filter, and $H_r(f)$ is a complex frequency response associated with the rear microphone filter.

The sensor-weight vector, $w_O(f)$, that maximizes the directional gain may be calculated as follows:

$w_O(f)=[R_N(f)+\delta(f)I]^{-1}s(f)$, where I is an identity matrix the same size as $R_N(f)$, and $\delta(f)$ is a small positive value that controls the amount of noise amplification.

By substituting the previous expressions for $R_N(f)$ and s(f), a closed form expression for the optimal sensor-weight vector, $w_O(f)$, can be derived as follows:

$$w_O(f) = \frac{1}{\Delta}\begin{bmatrix} (1+\delta(f)) - \rho e^{-jkd} \\ -\rho + (1+\delta(f))e^{-jkd} \end{bmatrix}, \text{ where } \rho = \frac{\sin(kd)}{kd}$$

and $\Delta=(1+\delta(f))^2-\rho^2$

The optimal sensor-weight vector, $w_O(f)$, may thus be calculated by determining values for the parameter $\delta(f)$ that produce the desired maximum noise amplification over the frequency band of interest. Given a desired level of maximum noise amplification, $G_N$, the parameter $\delta(f)$ may be calculated for each frequency in the frequency band of interest, as follows:

$T=1/G_N$ $\delta(f)=x-1$ $a=(2-T)$ $b=(2T-4)\rho\cos(\omega d/v)$ $c=\rho^2(2\cos^2(\omega d/v)-T)$ $$x = \frac{-b+\sqrt{b^2-4ac}}{2a}$$

where ω is the radian frequency (2πf), d is the spacing between the front and rear microphones 81, 82, v is the speed of sound, and $$\rho = \frac{\sin(\omega d/v)}{(\omega d/v)}.$$

In order to implement a directional microphone array using the optimal sensor-weight vector, $w_O(f)$, as described above, filters with the specified magnitude and phase responses may be constructed for both the front and rear microphone signals. The filters required for this implementation, however, may not be practical for some applications. A considerable simplification results by normalizing the front and rear microphone filter responses by the front microphone response, as the array processing equations are invariant to a constant multiplied by the sensor-weight vector. The result of this normalization is to eliminate the front microphone filter and reduce the rear microphone filter to an allpass filter, as follows:

$$w_O(f) = \begin{bmatrix} 1 \\ \frac{-\rho + (1+\delta(f))e^{-jkd}}{(1+\delta(f)) - \rho e^{-jkd}} \end{bmatrix}.$$

Using the result from the above equations, the frequency-dependent phase shift, $\theta_{LN}$, implemented by the low-noise phase-shifting circuit 84 may be calculated for each frequency in the band of interest, as follows:

$$\theta_{LN} = -\frac{\omega d}{v} - 2\tan^{-1}\left[\frac{(x\sin(\omega d/v)/\rho}{1-\frac{x}{\rho}\cos(\omega d/v)}\right]$$

Figure 5:
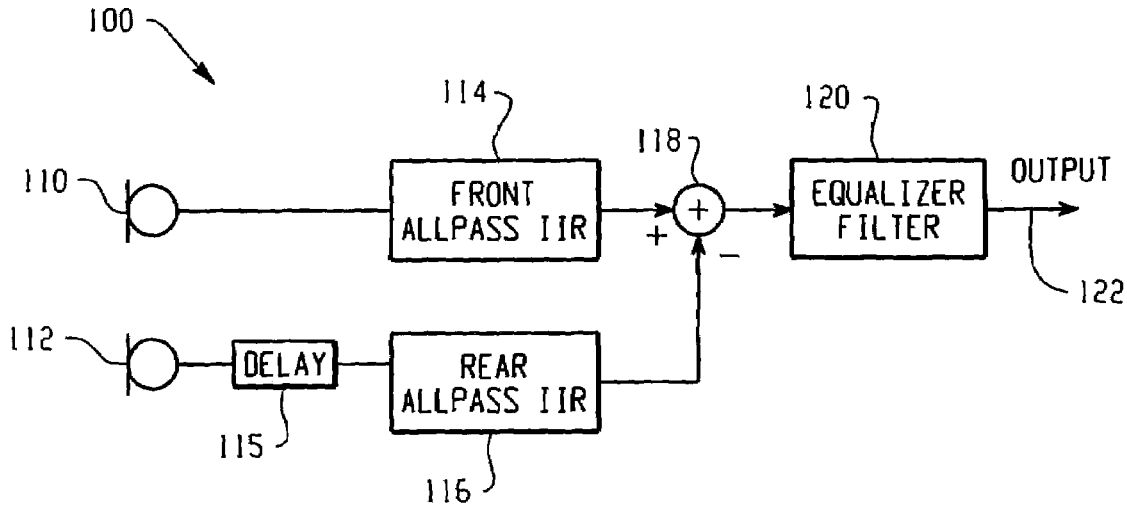
FIG. 5 is a block diagram illustrating one exemplary implementation of the low-noise directional microphone system of FIG. 4.

FIG. 5 is a block diagram illustrating one exemplary implementation 100 of the low-noise directional microphone system 80 of FIG. 4. This embodiment includes a front microphone 110, a rear microphone 112, a front allpass IIR filter 114, a time delay circuit 115, and a rear allpass IIR filter 116. In addition, the directional microphone system 100 also includes a summation circuit 118 and an equalization (EQ) filter 120. The front and rear microphones 110, 112 may, for example, be the front and rear microphones 24, 26 in a digital hearing instrument 12, as shown in FIG. 3A. The allpass filters 114, 116, time delay circuit 115, summation circuit 118 and equalization filter 120 may, for example, be part of the directional processor and headroom expander 50 in a digital hearing instrument 12, as described above with reference to FIG. 3A.

The front and rear microphones 110, 112 are preferably omnidirectional microphones that receive an acoustical waveform and generate a front and rear microphone signal, respectively. The front microphone signal is coupled to the front allpass filter 114, and the rear microphone signal is coupled to the time delay circuit 115. The time delay circuit 115 implements a time-of-flight delay that compensates for the distance between the front and rear microphones 110, 112 and determines the specific nature of the directional microphone pattern (i.e., cardioid, hyper-cardioid, bi-directional, etc.).

Figure 1:
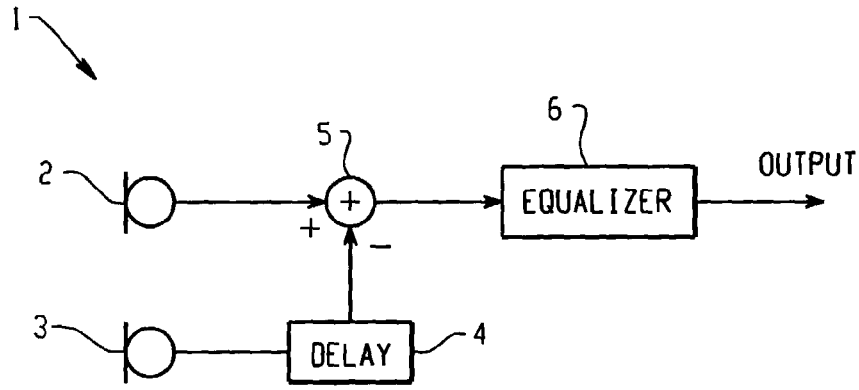
Fig. 1 RELATED ART
FIG. 1 is a block diagram illustrating a known method for implementing a directional microphone system.

The front and rear allpass filters 114, 116 are infinite impulse response (IIR) filters that apply a frequency-specific phase shift without significantly affecting the magnitudes of the microphone signals. More specifically, the front and rear allpass filters 114, 116 apply an additional frequency-dependent phase shift ($\Delta\theta$), beyond that required for conventional directional microphone operation (see, e.g., FIG. 1), in order to maintain a maximum desired noise amplification level in the directional microphone signal (see, e.g., FIG. 9). The design target for this inter-microphone phase shift, $\Delta\theta$, implemented by the front and rear allpass filters 114, 116 may be calculated from the conventional phase shift ($\theta_C$) and the low-noise phase shift ($\theta_{LN}$). The low-noise phase shift, $\theta_{LN}$, is calculated for each frequency in the band of interest, as described above with reference to FIG. 4. The conventional phase shift, $\theta_C$, for a hyper-cardioid microphone can be obtained using the equation for the optimum array processing weights by setting the parameter $\delta(f)$ equal to zero:

$$\theta_C = -\frac{\omega d}{v} - 2\tan^{-1}\left[\frac{(\sin(\omega d/v)/\rho}{1-\frac{1}{\rho}\cos(\omega d/v)}\right]$$

The inter-microphone phase shift, $\Delta\theta$, is obtained by subtracting the conventional phase shift, $\theta_C$, from the low-noise phase shift, $\theta_{LN}$. It is this inter-microphone phase shift, $\Delta\theta=\theta_{LN}-\theta_C$, that is implemented by the front and rear allpass filters 114, 116. An exemplary method for implementing the front and rear allpass filters 114, 116 is described below with reference to FIG. 6.

The frequency-dependent phase shift, $\Delta\theta$, will produce a low-noise version of any desired directional microphone pattern, such as cardioid, super-cardioid, or hyper-cardioid. That is, the low-noise phase shift, $\Delta\theta$, is effective regardless of the exact directional microphone time delay.

The directional microphone signal is generated by the summation circuit 118 as the difference between the filtered outputs from front and rear allpass filters 114, 116, and is input to the equalization (EQ) filter 120. The equalization filter 120 equalizes the on-axis frequency response of the directional microphone signal to match that of a single, omnidirectional microphone, and generates the microphone system output signal 122. More particularly, the on-axis frequency response of the directional microphone signal will typically exhibit a +6dB/octave slope over some frequency regions and an irregular response over other regions. The equalization filter 120 is implemented using standard audio equalization methods to flatten this response shape. The equalization filter 120 will therefore typically include a combination of low-pass and other audio equalization filters, such as graphic or parametric equalizers.

Figure 6:
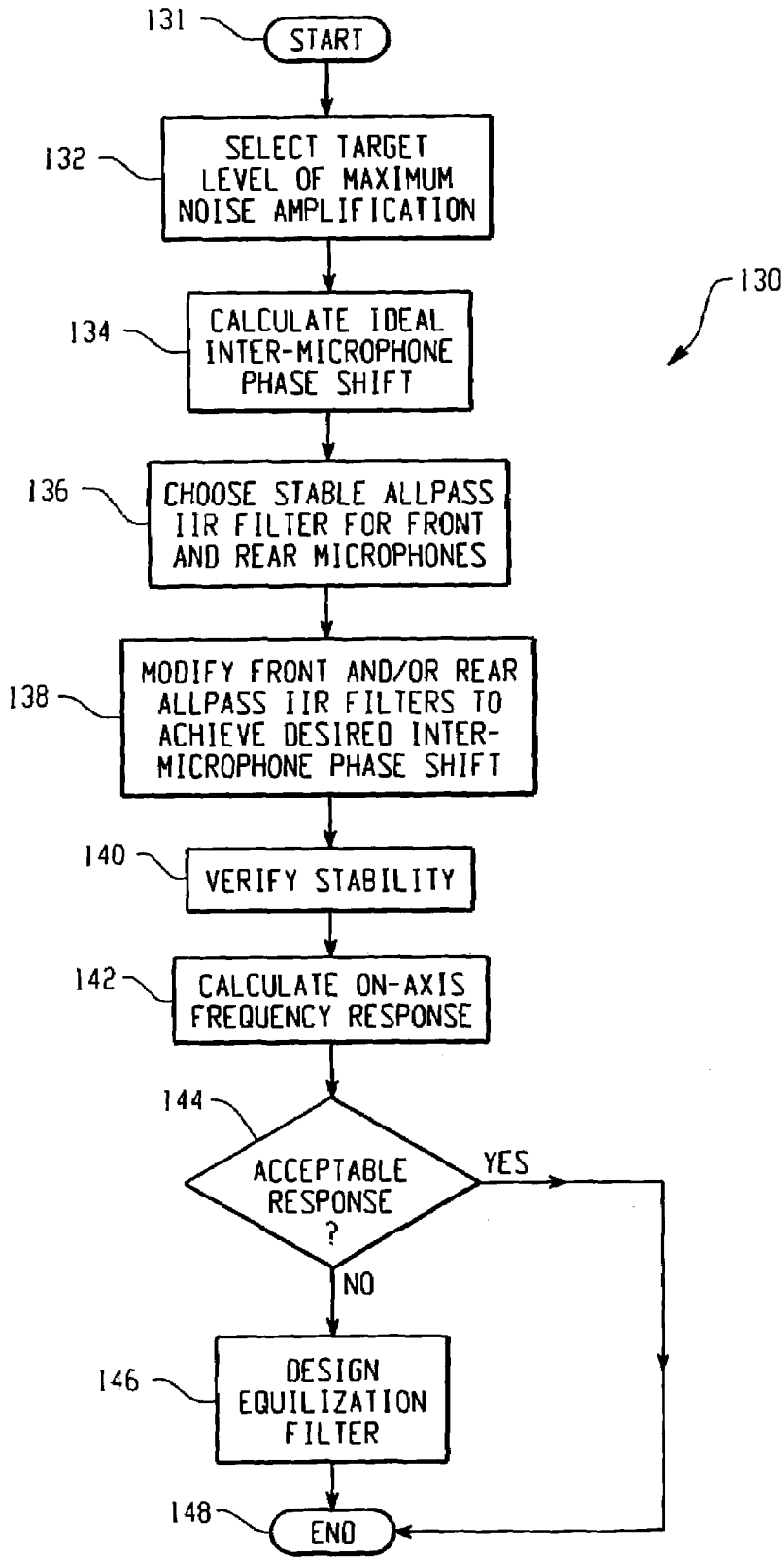
FIG. 6 is a flow diagram showing an exemplary method for designing the front and rear allpass infinite impulse response (IIR) filters of FIG. 5.

FIG. 6 is a flow diagram 130 showing an exemplary method for designing the front and rear allpass IIR filters 114, 116 of FIG. 5 using the inter-microphone phase shift $\Delta\theta$. The method starts in step 131. In step 132, a target level of maximum noise amplification, $G_N$, is selected for the microphone system 100. Exemplary maximum noise amplification levels ($G_N$) for a low-noise directional microphone system with a 10.7 mm port spacing are described below with reference to FIG. 7. Once the target maximum noise amplification level, $G_N$, is selected, then the inter-microphone phase shift, $\Delta\theta$, is calculated in step 134, as described above.

In step 136, a stable allpass IIR filter is selected for both the front and rear allpass filters 114, 116. Then, in step 138, either the front allpass filter 114, the rear allpass filter 116 or both are modified to approximate the desired inter-microphone phase shift, $\Delta\theta$. For example, the rear allpass filter 116 phase target may be obtained by adding $\Delta\theta$ to the phase response of the stable front allpass filter 114 selected in step 136. This phase target may then be used to modify the rear allpass filter 116. Techniques for selecting a stable allpass IIR filter and for modifying one of a pair of filters to achieve a desired phase difference are known to those skilled in the art. For example, standard allpass IIR filter design techniques are described in S.S. Kidambi, "Weighted least-square design of recursive allpass filters", *IEEE Trans. on Signal Processing*, Vol. 44, No. 6, pp. 1553-1557, June 1996.

In step 140, the stability of the front and rear allpass filters 114, 116 are verified using known techniques. Then in step 142, the on-axis frequency response, $G_S(f)$, of the directional microphone signal is calculated at a number of selected frequency points within the frequency band of interest, as follows:

$$G_S(f)=w_O(f)^H s(f)$$

If the resulting frequency response, $G_S(f)$, matches the desired frequency response within acceptable limits (for example, ±3 dB) at step 144, then the method ends at step 148. If, however, it is determined at step 144 that the frequency response, $G_S(f)$, is not within acceptable limits, then an equalization filter 120 is designed at step 146 with a combination of low-pass and other audio equalization filters, using known techniques as described above. That is, the equalization filter 120 shown in FIG. 5 may be omitted if an acceptable on-axis frequency response, $G_S(f)$, is achieved by the front and rear allpass filters 114, 116 alone.

Figure 7:
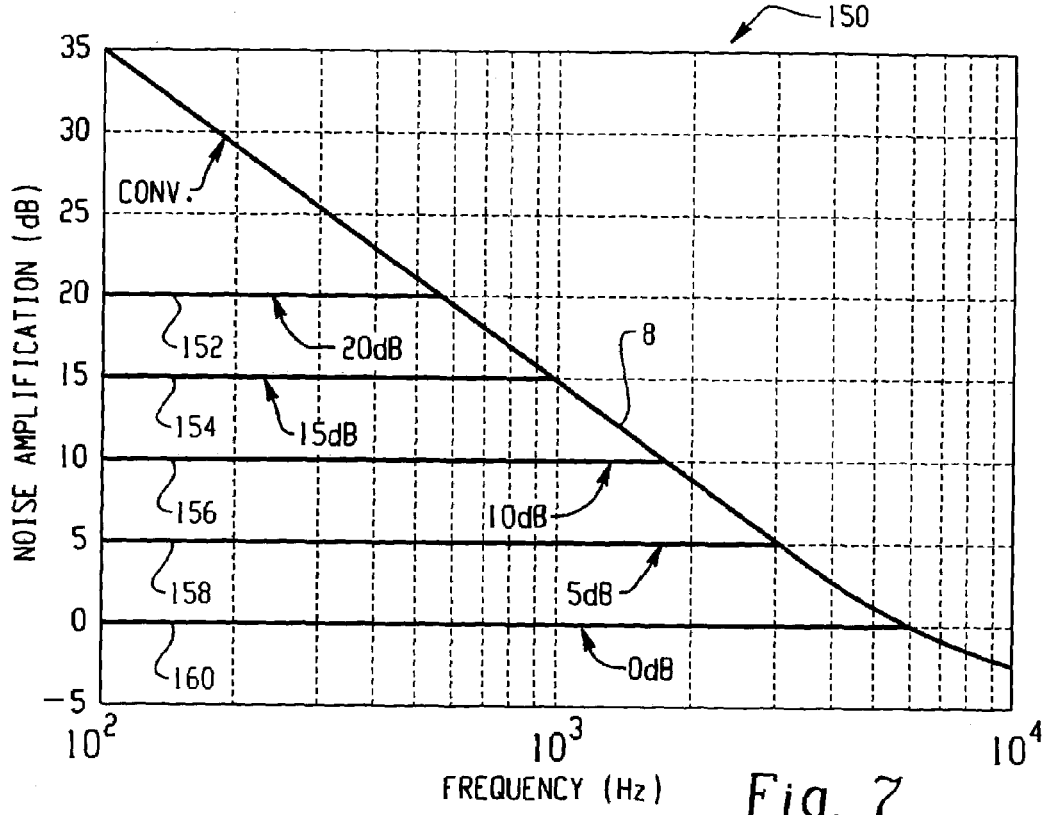
FIG. 7 is a graph illustrating desired maximum noise amplification levels (in dB) for a directional microphone system plotted as a function of frequency.
Figure 8:
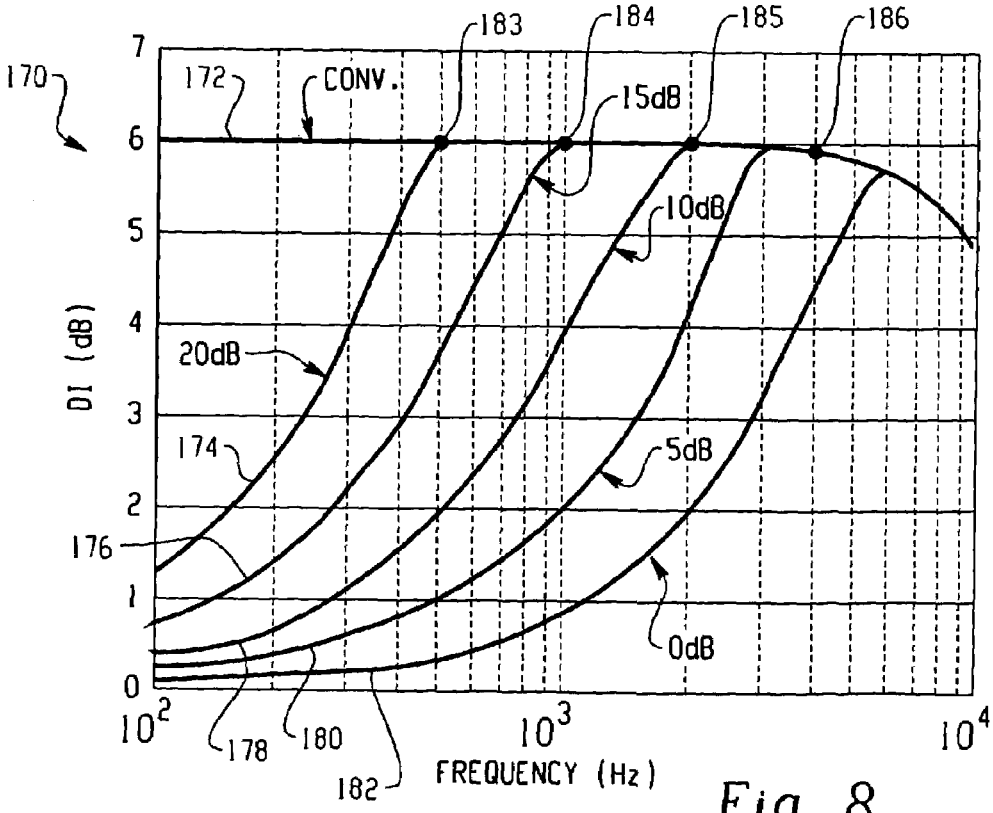
FIG. 8 is a graph illustrating a resultant directivity index for each of the maximum noise amplification levels of FIG. 7.
Figure 9:
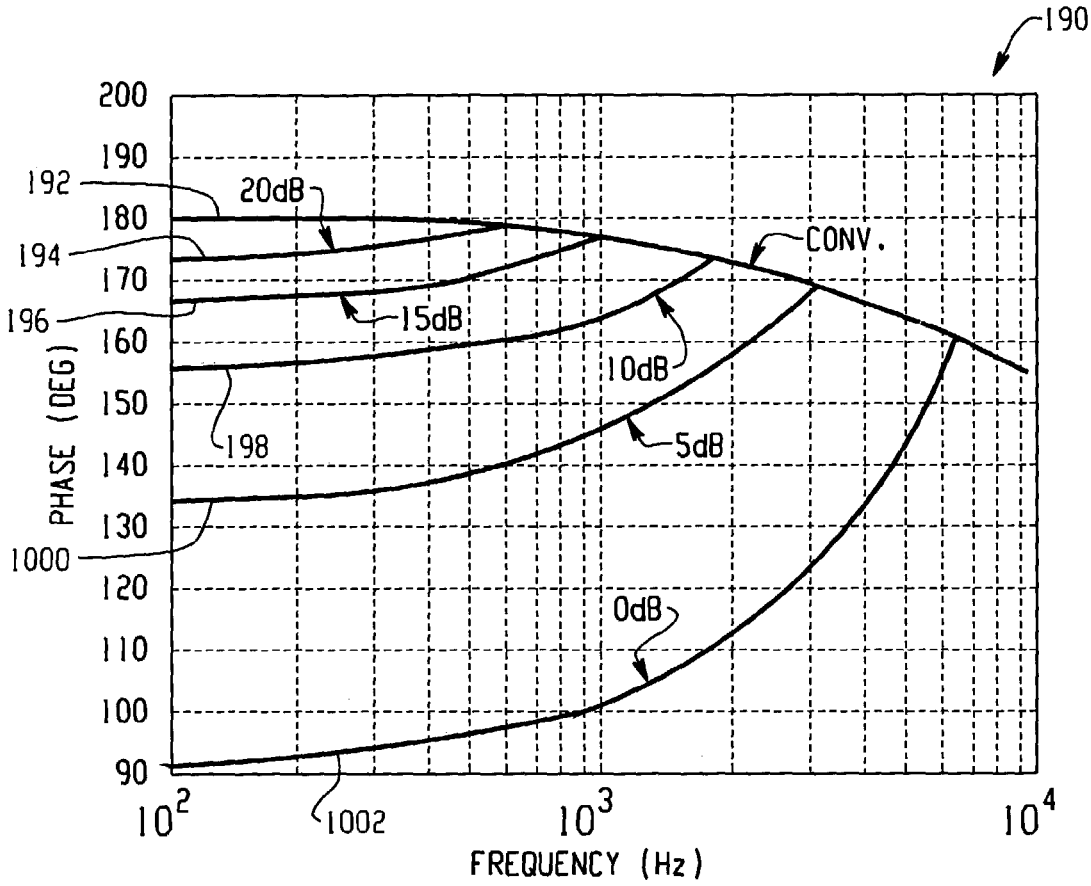
FIG. 9 is a graph illustrating exemplary frequency-dependent phase shifts that may be implemented to achieve the maximum noise amplification levels shown in FIG. 7.

As described above, the specific implementation of a low-noise directional microphone system is driven by the target value chosen for the maximum noise amplification level, $G_N$. This concept is best illustrated with an example. FIGS. 7-9 are graphs illustrating the exemplary operation of a directional microphone system having a port spacing of 10.7 mm. FIG. 7 is a graph illustrating desired maximum noise amplification levels for a directional microphone system. FIG. 8 is a graph illustrating a resultant directivity index for each of the maximum noise amplification levels of FIG. 7. FIG. 9 is a graph illustrating exemplary frequency-dependent phase shifts that may be implemented to achieve the maximum noise amplification levels shown in FIG. 7.

Figure 2:
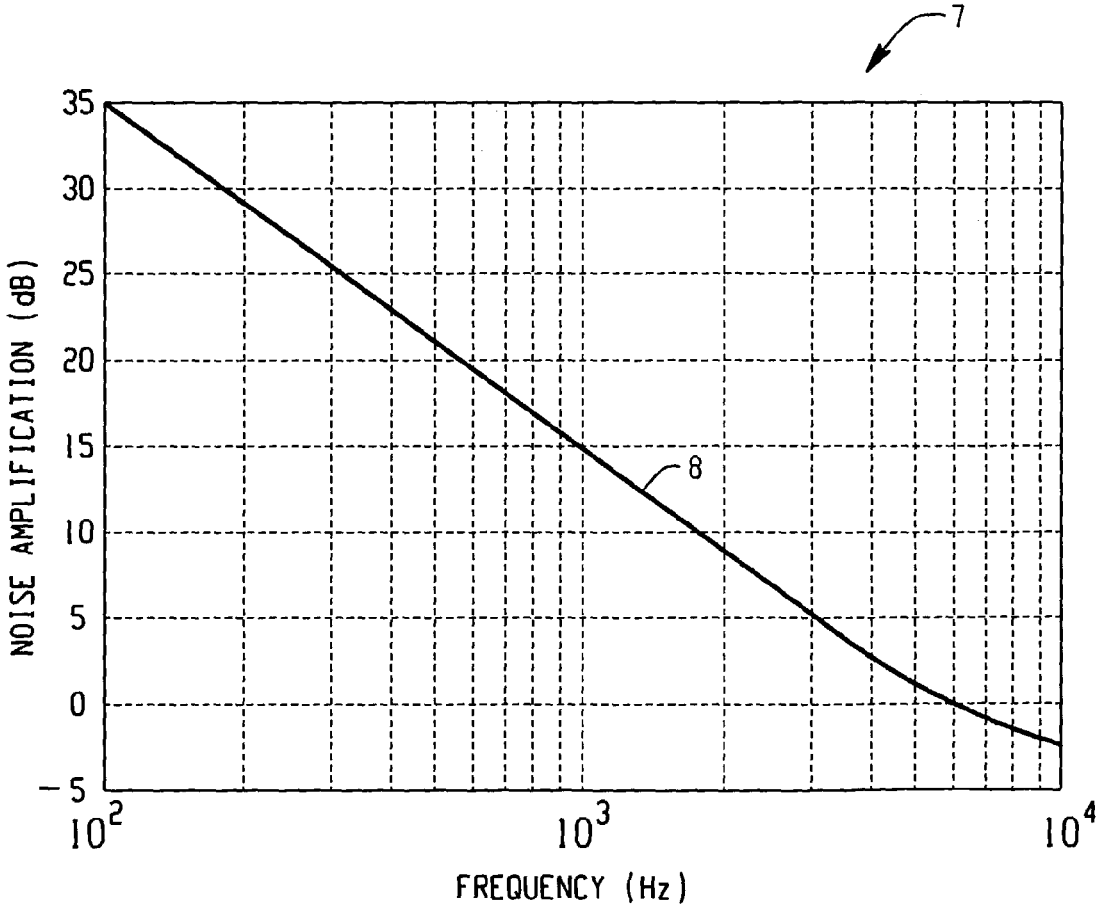
Fig. 2 RELATED ART
FIG. 2 is a graph illustrating noise amplification (in dB) in a typical directional microphone system 1 plotted as a function of frequency.

Referring first to FIG. 7, this graph 150 includes five maximum desired noise amplification levels 152, 154, 156, 158, 160 superimposed onto a typical noise amplification level 8 for a conventional directional microphone system, as shown in FIG. 2. For example, if a maximum noise amplification level of 20 dB is desired, then the directional microphone system should be designed to maintain the target noise level plotted at reference numeral 152. Other target noise levels illustrated in FIG. 7 include maximum noise amplification levels of 15 dB (plot 154), 10 dB (plot 156), 5 dB (plot 158), and 0 dB (plot 160). It should be understood, however, that other decibel levels could also be selected for the target maximum noise amplification level.

FIG. 8 plots the maximum directivity indices 172, 174, 176, 178, 180, 182 that result from the different target levels of noise amplification shown in FIG. 7. That is, the implementation of each of the maximum noise levels of FIG. 7 in a low-noise microphone system having a port spacing of 10.7 mm, should typically result in a corresponding maximum directivity index (DI), as plotted in FIG. 8. For example, the maximum DI for a 20 dB target noise amplification level is plotted at reference numeral 174. Also included in FIG. 8 is the maximum DI 172 achievable in a typical conventional directional microphone system, as shown in FIG. 2. The directivity index (DI) may be calculated from the above-described expression for directional gain (D(f), as follows:

$$DI = 10\log D(f) = 10\log\left[\frac{w^H R_S(f) w(f)}{w^H R_N(f) w(f)}\right]$$

A comparison of the maximum DI levels 174, 176, 178, 180, 182 in the exemplary low-noise directional microphone system with the maximum DI 172 in a conventional directional microphone system illustrates the loss of directionality at low frequencies in the low-noise directional microphone system. This loss of directionality may be balanced with the corresponding reduction in noise amplification in order to choose a maximum noise amplification target that is suitable for a particular application.

Also illustrated in FIG. 8 are four points 183, 184, 185, 186 corresponding to the DI 172 of the conventional directional microphone system at 500 Hz, 1000 Hz, 2000 Hz, and 4000 Hz, respectively. Hearing instrument manufacturers are typically concerned mostly with frequencies that are of primary importance to speech recognition. Consequently, the most common measure of directional performance is a weighted average of the DI at these four frequencies of interest, 500 Hz, 1000 Hz, 2000 Hz, and 4000 Hz. The weighted average at these four frequencies is referred to as the AI-DI. FIG. 8 illustrates that the DI at the highest frequencies used in the AI-DI calculation are much less affected by the restriction on noise amplification in this exemplary low-noise directional microphone system than the DI at low frequencies.

FIG. 9 illustrates the inter-microphone phase shifts 194, 196, 198, 1000, 1002 that may be implemented in a low-noise directional microphone system in order to achieve the maximum noise amplification levels of FIG. 7. Also illustrated in FIG. 9 is the phase shift 192 typically implemented in a conventional directional microphone system to compensate for the time-of-flight delay between microphones.

Figure 10:
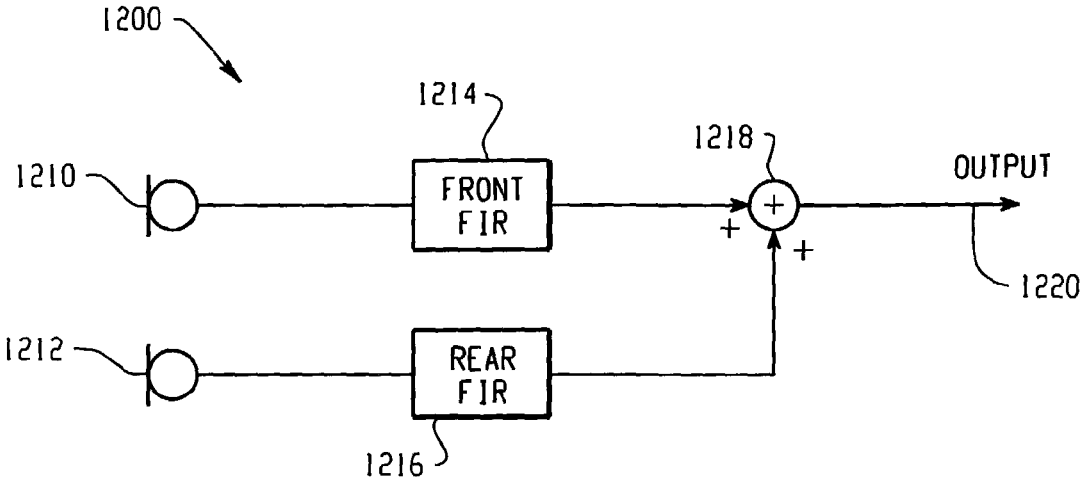
FIG. 10 is a block diagram of an exemplary low-noise directional microphone system utilizing finite impulse response (FIR) filters.

FIG. 10 is a block diagram of an exemplary low-noise directional microphone system 1200 utilizing finite impulse response (FIR) filters 1214, 1216. The microphone system 1200 includes a front microphone 1210, a rear microphone 1212, a front FIR filter 1214, a rear FIR filter 1216, and a summation circuit 1218. The front and rear microphones 1210, 1212 may, for example, be the front and rear microphones 24, 26 in the digital hearing instrument of FIG. 3. The FIR filters 1214, 1216 and summation circuit 1218 may, for example, be part of the directional processor and headroom expander 50, described above with reference to FIG. 3.

Operationally, the front and rear microphones 1210, 1212 receive an acoustical waveform and generate front and rear microphone signals, respectively. The front and rear microphones 1210, 1212 are preferably omnidirectional microphones, but matched, directional microphones could also be used. The front microphone signal is coupled to the front FIR filter and the rear microphone signal is coupled to the rear FIR filter 1216. The filtered signals from the front and rear FIR filters 1214, 1216 are then combined by the summation circuit 1218 to generate the directional microphone signal 1220.

The front and rear FIR filters 1214, 1216 implement a frequency-dependent phase-response that compensates for the time-of-flight delay between the front and rear microphones 1210, 1212 and also maintains a maximum desired noise amplification level ($G_N$) in the resultant directional microphone signal, similar to the directional microphone systems described above with respect to FIGS. 4 and 5. In addition, since FIR filters are easily designed to arbitrary phase and magnitude specifications, equalization functionality may be designed directly into the front and rear FIR filters 1214, 1216 in order to equalize the on-axis frequency response of the resultant directional microphone signal 1220.

More specifically, the front and rear FIR filters 1214, 1216 may be implemented from the above-described expression for the optimal sensor-weight vector, $w_O(f)$:

$$w_o(f) = \frac{1}{\Delta}\begin{bmatrix} (1+\delta(f)) - \rho e^{-jkd} \\ -\rho + (1+\delta(f))e^{-jkd} \end{bmatrix}, \text{ where } \rho = \frac{\sin(kd)}{kd}$$

and $\Delta=(1+\delta(f))^2-\rho^2$

As noted above, the optimal sensor-weight vector, $w_O(f)$, may be calculated by determining values for the parameter $\delta(f)$ that produce the desired maximum noise amplification over the frequency band of interest. Given a desired level of maximum noise amplification, $G_N$, the parameter $\delta(f)$ may be calculated for each frequency in the frequency band of interest, as described above. In contrast to the allpass IIR filters 114, 116 of FIG. 5, however, the design target for the front and rear FIR filters 1214, 1216 is obtained without normalizing the front and rear responses. Thus, the design target for the front FIR filter 1214 may be expressed as:

$$H_f(f) = \frac{1}{\Delta}\left[(1+\delta(f)) - \rho e^{-jkd}\right]$$

The design target for the rear FIR filter 1216 may be expressed as:

$$H_r(f) = \frac{1}{\Delta}\left[-\rho(1+\delta(f))e^{-jkd}\right]$$

Using the above design targets for the front and rear FIR filters 1214, 1216, FIR filters may be designed using known FIR filter design techniques, such as described in T. W. Parks & C. S. Burrus, *Digital Filter Design*, John Wiley & Sons, Inc., New York, N.Y., 1987.

In addition, if the on-axis frequency response of the directional microphone signal 1220 does not match the desired frequency response within acceptable limits (for example, ±3 dB), then the above design targets may be modified to include amplitude response equalization for the directional microphone output 1220. For example, amplitude response equalization may be incorporated into the FIR filter design targets by normalizing the target responses in each microphone by the on-axis frequency response, $G_S(f)$, as follows:

$$G_S(f) = \frac{2}{\Delta}[(1+\delta(f)) - \rho\cos(kd)]$$

$$H_f(f) = \frac{\left[(1+\delta(f)) - \rho e^{-jkd}\right]}{2\left[(1+\delta(f)) - \rho\cos(kd)\right]}$$

$$H_r(f) = \frac{\left[-\rho + (1+\delta(f))e^{-jkd}\right]}{2\left[(1+\delta(f)) - \rho\cos(kd)\right]}$$

Figure 11:
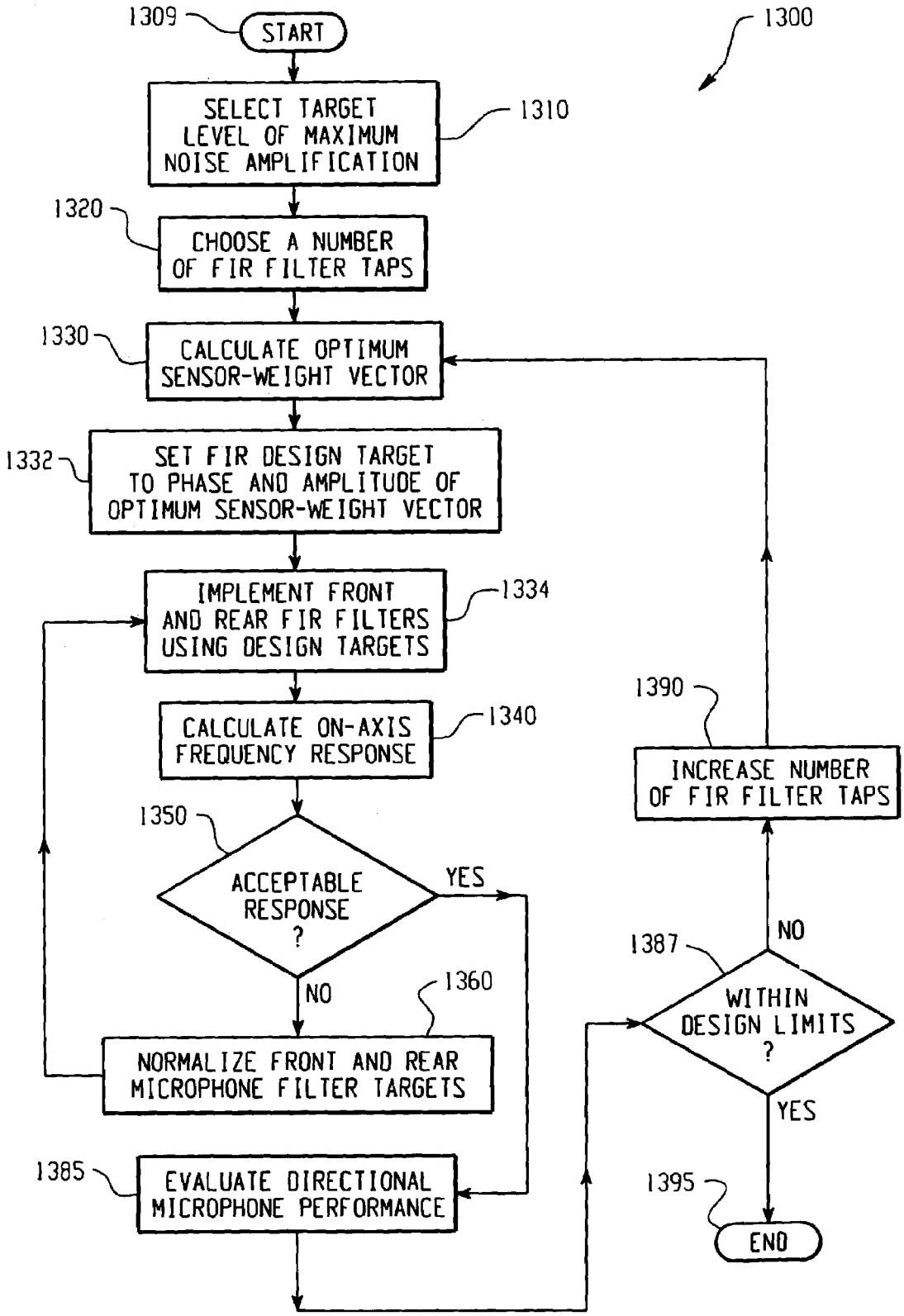
FIG. 11 is a flow diagram showing an exemplary method for designing the front and rear FIR filters of FIG. 10.

FIG. 11 is a flow diagram showing an exemplary method for designing the front and rear FIR filters 1214, 1216 of FIG. 10. The method begins at step 1309. At step 1310, a target maximum level of noise amplification, $G_N$, is selected for the low-frequency directional microphone system 1200, as described above. At step 1320, the number of FIR filter taps for each of the front and rear FIR filters 1214, 1216 is selected. Having selected the target noise amplification level and number of FIR filter taps, the optimum sensor-weight vector, $w_O(f)$, is calculated at a number of selected frequency points within the frequency band of interest in step 1330, as described above. The design targets are then set to the phase and amplitude of the sensor-weight vector at step 1332, and the FIR filters are implemented from the design targets at step 1334.

In step 1340, the on-axis frequency response of the resultant directional microphone output 1220 is calculated, as described above. If the on-axis frequency response is within acceptable design limits (step 1350), then the method proceeds to step 1385, described below. If the on-axis frequency response calculated in step 1340 is not within acceptable design limits, however, then in 1360 the design targets for the front and rear FIR filters 1214, 1216 are modified to provide amplitude response equalization for the directional microphone output 1220, and the method returns to step 1334.

In step 1385, the actual directivity (DI) and noise amplification ($G_N$) levels for the directional microphone system 1200 are evaluated. If the directivity (DI) and maximum noise amplification ($G_N$) are within the acceptable design parameters (step 1387), then the method ends at step 1395. If the directional microphone performance is not within acceptable design limits, however, then the selected number of FIR filter taps may be increased at step 1390, and the method repeated from step 1330. For example, the design limits may require the maximum noise amplification level ($G_N$) achieved by the directional microphone system 1200 to fall within 1 dB of the target level chosen in step 1310. If the system 1200 does not perform within the design parameters, then number of FIR filter taps may be increased at step 1390 in order to increase the resolution of the filters 1214, 1216 and better approximate the design targets.

Figure 12:
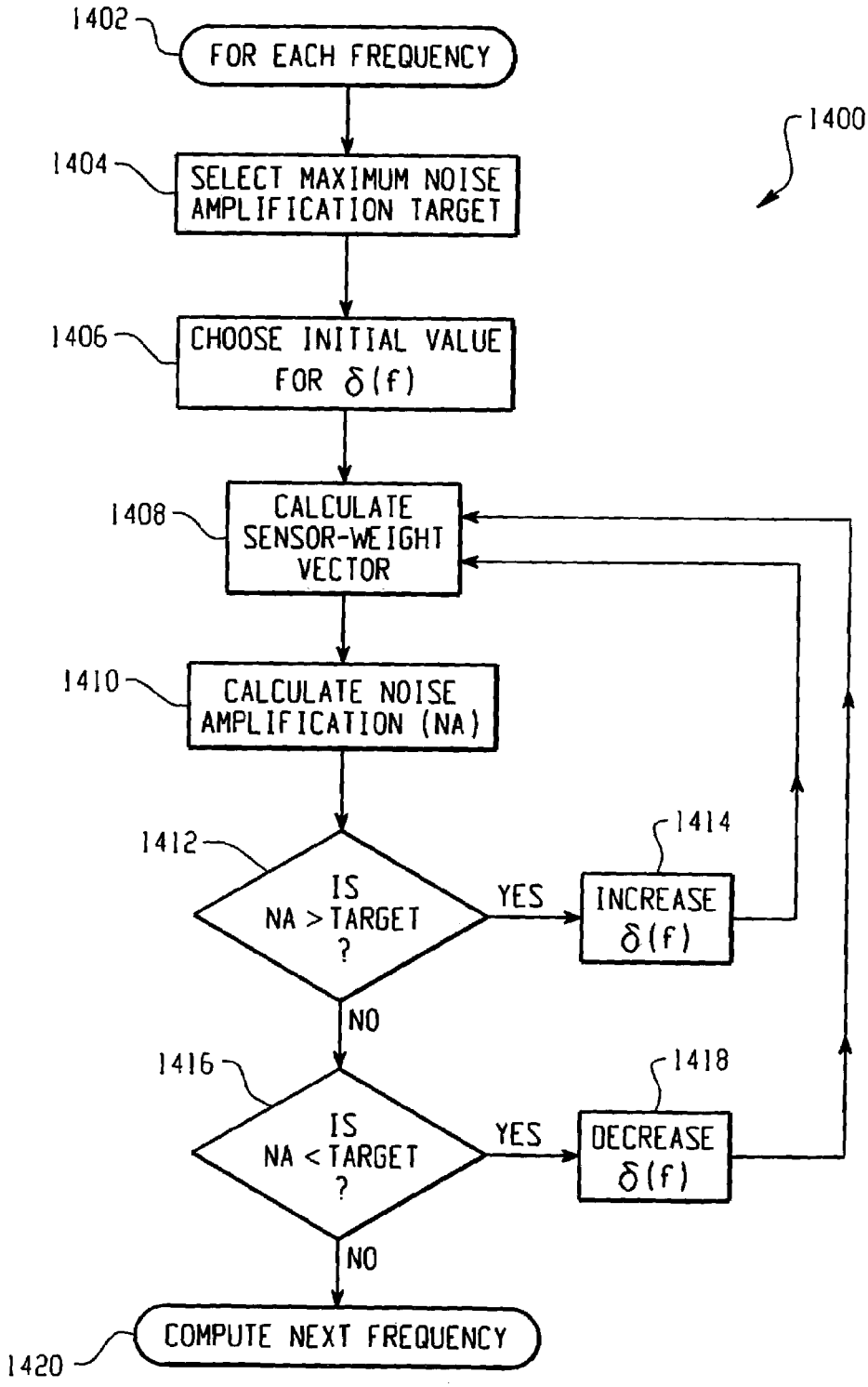
FIG. 12 is a flow diagram showing one alternative method for calculating the optimum microphone weights implemented by the front and rear filters in the directional microphone systems of FIGS. 5 and 10.

FIG. 12 is a flow diagram 1400 showing one alternative method for calculating the optimum microphone weights implemented by the front and rear filters in the directional microphone systems of FIGS. 5 and 10. In the above description of FIGS. 5 and 10, the value of the parameter δ(f) in the expression for the optimal sensor-weight vector, $w_O(f)$, is calculated using a set of closed form equations. The method 1400 illustrated in FIG. 12 provides one alternative method for iteratively calculating the optimal value for δ(f) at each frequency within the band of interest, given a desired level of maximum noise amplification, $G_N$.

The method begins at 1402 and repeats for each frequency within the frequency band of interest. At step 1404 the target maximum noise amplification level, $G_N$, is selected as described above. Then, an initial value for δ(f) is selected at step 1406, and the sensor-weight vector, $w_O(f)$, is calculated at step 1408 using the initialized value for δ(f). The resultant noise amplification, $G_N$, for the particular frequency is then be calculated at step 1410, as follows:

$$G_N = \frac{w^H(f)w(f)}{w^H(f)R_S(f)w(f)}$$

If the calculated value for $G_N$ is greater than the target value (step 1412), then the value of δ(f) is increased at step 1414, and the method is repeated from step 1408. Similarly, if the calculated value for $G_N$ is less than the target value (step 1416), then the value of δ(f) is decreased at step 1418, and the method is repeated from step 1408. Otherwise, if the calculated value for $G_N$ is within acceptable design limits, then the value for δ(f) at the particular frequency is set, and the method repeats (step 1420) until a value for δ(f) is set for each frequency in the band of interest.

This written description uses examples to disclose the invention, including the best mode, and also to enable a person skilled in the art to make and use the invention. The patentable scope of the invention is defined by the claims, and may include other examples that occur to those skilled in the art.

Figure 13:
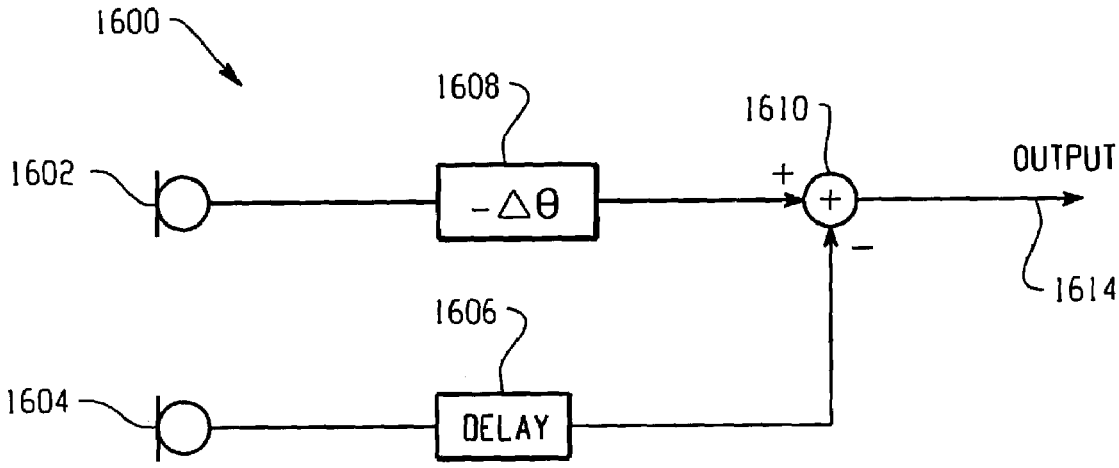
FIG. 13 is a block diagram illustrating one alternative embodiment of the low-noise directional microphone system shown in FIG. 4.

For example, FIG. 13 is a block diagram illustrating one alternative embodiment 1600 of the low-noise directional microphone system shown in FIG. 4. The low-noise directional microphone system shown in FIG. 13 includes a front microphone 1602, a rear microphone 1604, a time-of-flight delay circuit 1606, a low-noise phase-shifting circuit 1608, and a summation circuit 1610. This embodiment 1600 is similar to the directional microphone system 80 of FIG. 4, except that the inter-microphone phase shift that creates the controlled loss in directional gain necessary to maintain the desired maximum level of noise amplification is applied to the front microphone signal instead of the rear microphone signal.

More particularly, the front and rear microphones 1602, 1604 receive an acoustical waveform and generate a front and rear microphone signal, respectively. The front microphone signal is coupled to the low-noise phase-shifting circuit 1608 and the rear microphone signal is coupled to the time-of-flight delay circuit 1606. The low-noise phase-shifting circuit 1608 implements a frequency-dependent phase shift ($-\Delta\theta$) in order to maintain the maximum desired noise amplification level, as described above. The time-of-flight delay circuit 1606 implements a frequency-dependent time delay to compensate for the time-of-flight delay between the front and rear microphones 1602, 1604, similar to the delay circuit 115 described above with reference to FIG. 5. Similar to the inter-microphone phase shift, $\Delta\theta$, described above with reference to FIG. 5, the frequency-dependent phase shift ($-\Delta\theta$) of this alternative embodiment 1600 is the difference between the conventional phase shift, $\theta_C$, and the low-noise phase shift, $\theta_{LN}$. The directional microphone signal 1614 is generated by the summation circuit 1610 as the difference between the filtered outputs of the low-noise phase-shifting circuit 1608 and the time-of-flight delay circuit 1606.

It is claimed:

1. A hearing instrument, comprising:

a front microphone that generates a front microphone signal;

a rear microphone that generates a rear microphone signal;

a phase-shifting circuit that implements a frequency-dependent phase shift between the front microphone signal and the rear microphone signal to create a controlled loss in directional gain and maintain a predetermined maximum level of microphone self noise amplification ($G_N$) over a pre-determined frequency band, the frequency-dependent phase shift being configured to provide a maximum amount of directional gain given the predetermined maximum level of microphone self noise amplification ($G_N$);

the frequency-dependent phase shift ($\theta_{LN}$) including an inter-microphone phase shift ($\Delta\theta$) in addition to a time-of-flight delay ($\theta_C$), such that $\Delta\theta=\theta_{LN}-\theta_C$; and wherein the frequency-dependent phase shift ($\theta_{LN}$) satisfies the following equation:

$$\theta_{LN} = -\frac{\omega d}{v} - 2\tan^{-1}\left[\frac{x\sin(\omega d/v)/\rho}{1-\frac{x}{\rho}\cos(\omega d/v)}\right],$$

where ω is the radian frequency (2πf), d is the spacing between the front and rear microphones, v is the speed of sound, $$\rho = \frac{\sin(\omega d/v)}{(\omega d/v)},$$

and x is a function of the predetermined maximum level of microphone self noise amplification ($G_N$).

2. The hearing instrument of claim 1, wherein x satisfies the following set of equations:

$$T = \frac{1}{G_N};$$

$$a = (2-T);$$

$$b = (2T-4)\rho\cos(\omega d/v);$$

$$c = \rho^2(2\cos^2(\omega d/v) - T); \quad \text{and}$$

$$x = \frac{-b+\sqrt{b^2-4ac}}{2a}.$$

3. The hearing instrument of claim 1, wherein the time-of-flight delay ($\theta_C$) satisfies the following equation:

$$\theta_C = -\frac{\omega d}{v} - 2\tan^{-1}\left[\frac{(\sin(\omega d/v)/\rho}{1-\frac{1}{\rho}\cos(\omega d/v)}\right].$$

* * * * *